US005108585A

United States Patent [19]

von Rybinski et al.

[11] Patent Number: 5,108,585

[45] Date of Patent: Apr. 28, 1992

[54] FLOTATION OF NON-SULFIDIC ORE WITH A GLYCOSIDIC COLLECTOR

[75] Inventors: Wolfgang von Rybinski, Duesseldorf; Rita Koester, Neuss; Manfred Biermann, Muelheim; Harald Schnegelberger, Leichlingen, all of Fed. Rep. of Germany

[73] Assignee: Henkel Kommanditgesellschaft auf Aktien, Duesseldorf, Fed. Rep. of Germany

[21] Appl. No.: 481,808

[22] Filed: Feb. 20, 1990

Related U.S. Application Data

[63] Continuation of Ser. No. 368,962, Jun. 19, 1989, abandoned, which is a continuation of Ser. No. 920,492, Oct. 17, 1986, abandoned.

[30] Foreign Application Priority Data

Oct. 17, 1985 [DE] Fed. Rep. of Germany ..... 3536975

[51] Int. Cl.[5] ..... B03D 1/14

[52] U.S. Cl. ..... 209/166; 252/61

[58] Field of Search ..... 209/166; 252/61

[56] References Cited

U.S. PATENT DOCUMENTS

| | | | |
|---|---|---|---|
| 3,547,828 | 12/1970 | Mansfield et al. | 252/351 |
| 3,598,865 | 8/1971 | Lew | 260/210 |
| 3,640,862 | 2/1972 | Gieseke et al. | 209/166 X |
| 3,707,535 | 12/1972 | Lew | 260/210 |
| 3,737,426 | 6/1973 | Throckmorton et al. | 260/210 R |
| 3,772,269 | 11/1973 | Lew | 260/210 |
| 3,839,318 | 10/1974 | Mansfield | 260/210 |
| 4,000,080 | 12/1976 | Bartolotia et al. | 252/99 |
| 4,089,945 | 5/1978 | Brinkman et al. | 252/107 |
| 4,138,350 | 2/1979 | Wang et al. | 209/166 X |
| 4,139,481 | 2/1979 | Wang et al. | 209/166 X |
| 4,349,669 | 9/1982 | Klahr et al. | 536/127 |
| 4,457,850 | 7/1984 | Tesmann et al. | 252/61 |
| 4,526,696 | 7/1985 | Delourme et al. | 252/61 |
| 4,565,647 | 1/1986 | Llenado | 252/354 |
| 4,594,151 | 6/1986 | DeLourme et al. | 209/166 |
| 4,663,069 | 5/1987 | Llenado | 252/117 |

FOREIGN PATENT DOCUMENTS

| | | |
|---|---|---|
| 0070074 | 7/1982 | European Pat. Off. . |
| 0077167 | 4/1983 | European Pat. Off. . |
| 0107561 | 10/1983 | European Pat. Off. . |
| 2547987 | 12/1977 | Fed. Rep. of Germany . |

OTHER PUBLICATIONS

Transaction/Section C of the Inst. of Mining and Metallurgy 1975.

Influence of nonionic surfactants, Doren, Van Lierde, de Cuyper.

A. M. Gaudin Memorial Volume 3 (1976).

Reagents in the Minerals Industry, Ed. Jones and Oblatt.

Inst. J. Min. Proc. 9 (1982) pp. 353–384.

Colloid & Polymer Soc. 259, 775–776 (1981).

*Primary Examiner*—John S. Maples

*Attorney, Agent, or Firm*—Ernest G. Szoke; Wayne C. Jaeschke; Henry E. Millson, Jr.

[57] ABSTRACT

A collecting agent and method for the recovery of valuable minerals in the froth flotation beneficiation of non-sulfidic ores is provided. The collecting agent is selected from alkyl glycosides, alkenyl glycosides and mixtures thereof. Preferably, the collecting agent is a combination of an alkyl glycoside, an alkenyl glycoside and mixtures thereof with a non-thio ionizable surfactant collector. Glycosides containing from about 2 to 8 glycoside residues may be used. The alkyl and alkenyl components of these glycosides may be linear or branched, may contain from about 2 to 18 carbon atoms and may optionally contain a hydroxyl group or an ether linkage.

18 Claims, 2 Drawing Sheets

FLOTATION OF NON-SULFIDIC ORE WITH A GLYCOSIDIC COLLECTOR

This application is a continuation of application Ser. No. 07/368,962 filed on Jun. 19, 1989, now abandoned, which is a continuation of application Ser. No. 06/920,492 filed on Oct. 17, 1986, now abandoned.

BACKGROUND OF THE INVENTION

1. Field of the Invention

The present invention concerns the use of alkyl and alkenyl glycosides and mixtures thereof with non-thio surfactants as collectors in froth flotation processes for the beneficiation of non-sulfidic ores.

2. Description of Related Art

Non-sulfidic minerals include, for example, apatite ($3Ca_3(PO_4)_2CaF_2$), fluorite ($CaF_2$), scheelite ($CaWO_4$) and other salt-containing minerals, cassiterite ($SnO_2$), titanium oxides, zirconium oxides, other metal oxides, certain silicates and alumo-silicates.

Froth flotation separation is a benefication technique commonly used in the mining industry for upgrading the valuable mineral content of ores. In preparation for flotation, the comminuted ore (the ore may be ground, either by dry-grinding but preferably by wet-grinding) is suspended in an aqueous medium, typically water. Collectors are normally added to the ore suspension, frequently in conjunction with frothers and optionally other auxiliary reagents such as regulators, depressors (deactivators) and/or activators, in order to facilitate separation of the valuable mineral constituent(s) from the unwanted gangue constituents. The comminuted ore suspension (or pulp) is conditioned by these reagents for a period of time before a gas, typically air, is sparged into the suspension to produce a foam which selectively floats an ore constituent on the surface. The collector is a hydrophobic agent which selectively coats the surface of the ore constituent, causing gas bubbles formed during sparging to adhere to the coated constituent. The remaining constituents of the ore which are not coated by the collector remain in the aqueous phase. In normal flotation processes, the ore constituent-containing foam is skimmed and collected for further processing. In reverse flotation processes the gangue constituent is floated and wasted while the aqueous concentrate is saved. In either type of flotation process, the object of the flotation is to separate and recover as much of the valuable mineral constituent(s) of the ore as possible in as high a concentration as possible.

Non-thio ionizable surfactants are a recognized class of flotation surfactants and are chiefly represented by the following compounds:

1. Alkyl carboxylate derivatives of carboxylic acid, such as fatty acids, RCOOH, and their sodium ($RCOO^-Na^+$) or potassium ($RCOO^-K^+$) soaps.

2. Alkyl sulfates, $R—O—SO_3—Na^+,(K^+)$ and sulfonates $R—SO_3—Na^+,(K^+)$.

3. Alkyl phosphates; both monoalkyl and dialkyl.

4. Amines, alkyl derivaties of ammonia, $NH_3$, of which the primary amines $RNH_3$ are used in flotation in the form of unsubstituted amine salts such as acetate, $RNH_3^+CH_2COO^-$, or hydrochloride or hydrobromide, $RNH_3^+Cl^-$, ($Br^-$). The secondary amines, $R_1R_2NH^+$ are used in flotation less often but together with the tertiary amines, $R_1R_2NR_3$, are common emulsification agents, for example, dimyristylamine or dimethylmyristylamine. A modification of amine-type surfactants constitute the substituted amine salts, e.g., monoalkyl quaternary ammonium salts such as chlorides or bromides, $RN(CH_3)_3^+Cl^-$,($Br^-$), or dialkyl quaternary salts, $R_1R_2N(CH_3)_2^+{}^{Cl}-(Br^-)$.

Other alkyl or aryl derivatives of amines are guanidine, piperidine, pyridine, cyclohexylamine and aniline (aminobenzene). Of the preceding derivatives the most frequently encountered are alkyl pyridinium salts.

As regards the class of hydrolyzable compounds, only those reagents with R groups containing between about 8 and 20 carbon atoms are employed in flotation; homologues shorter than $C_8$ do not show enough surface activity, while homologues longer than about $C_{20}$ become too insoluble for flotation purposes. The solutions of all these compounds are strongly affected by pH, giving rise to hydrolysis or dissociation, which strongly influences the surface activity by providing either the molecular or the ionic species. Also, all long-chain homologues of this class of reagents form aggregates (called micelles) when their solutions reach concentrations higher than a so-called critical micelle concentration (CMC) whenever their temperatures is above a certain minimum temperature called the Krafft point.

Many non-thio ionizable surfactants are known to be useful as collectors in the flotation of non-sulfidic ores. Known anionic non-thio ionizable surfactants include, for example, saturated and unsaturated fatty acids, particularly tall oil fatty acids and oleic acid, alkyl sulfates, particularly alkyl sulfates derived from fatty alcohols or fatty alcohol mixtures, alkyl aryl sulfonates, alkyl sulfosuccinates, alkyl succinamates and acyl lactylates. Known cationic non-thio ionizable surfactants include, for example, primary aliphatic amines, particularly the fatty amines derived from vegetable or animal and also certain alkyl-substituted and hydroxalkyl-substituted alkylene diamines and water-soluble acid addition salts of these amines.

Many surfactant collectors used to float non-sulfidic minerals inherently develop a foam suitable for flotation. However, it is frequently necessary or desirable to further develop or modify the foaming properties using special frothers. Known flotation frothers include $C_4$–$C_{10}$ alcohols, polypropylene glycols, polyethylene glycol, polypropylene glycol ethers, terpene alcohols (pine oils) and cresyl acids. If necessary, modifying reagents, for example, pH regulators, activators for the desirable mineral constituents to be recovered in the foam or deactivators for the gangue constituents to be wasted in the underflow and possibly even dispersants may be added to the flotation suspension (pulp).

In contrast to anionic and cationic surfactants, nonionic surfactants are rarely used as flotation collectors. In Trans. Inst. Met. Min. Sect. C., 84 (1975), pp. 34–39, A Doren, D. Vargas and J. Goldfarb conducted flotation tests on quartz, cassiterite and chrysocolla using a collector comprising an adduct of 9 to 10 moles ethylene oxide with octyl phenol.

Collectors comprising a combination of an ionic and a nonionic surfactant have also been described in the relevant literature. A. Doren, A. van Lierde and J. A. de Cuyper report in Dev. Min. Proc. 2 (1979), pp. 86–109 carried out flotation tests on cassiterite with a collector comprising a combination of an adduct of 9 to 10 moles ethylene oxide with octyl phenol and an octadecyl sulfosuccinate. In A.M. Gaudin Memorial Volume edited by M/C. Fuerstenau, AIME, New York, 1976, Vol. I, pp. 597-620. V. M. Lovell describes flotation tests carried out on apatite with a collector comprising a combination of a tall oil fatty acid and nonyl phenol tetraglycol ether.

U.S. Pat. No. 4,526,696 to Delourme et al discloses a collecting composition, in the form of a micro-emulsion, for the froth flotation beneficiation of minerals. The minerals floated in the examples of this patent include a sulfide mineral of copper and a sulfided lead-zinc mineral. Other ores are mentioned in the patent specification. The collecting composition includes a collector, a liquid surfactant, a co-surfactant and optionally water. The collector is selected from organic compounds containing sulfur such as mercaptans, thioethers and polysulfides. As the liquid surfactant component, nonionic, cationic and anionic surfactants are mentioned, although nonionic surfactants are said to be preferred. Examples of nonionic surfactants mentioned in the patent include polyoxyalkylenes, esters and ethers of polyoxyalkylenes, polyoxyalkylene thioethers and alkyl glucosides. The co-surfactant component is typically an alcohol having 3 to 8 carbon atoms.

The cationic, anionic and ampholytic non-thio ionizable collectors that have been previously used for the flotation of nonsulfidic ores often do not permit satisfactory recovery of the valuable minerals when the collectors are used in economically feasible quantities. Accordingly, it is an object of the present invention to provide an economically feasible froth flotation process for the beneficiation of non-sulfidic ores. It is another object to provide a collector, for use in such flotation processes, with which it is possible to obtain either greater yield of valuable mineral using the same quantity of collector or the same yield of valuable mineral using a reduced quantity of collector.

A further object of the invention is to improve the efficiency of known primary collectors used for the flotation of non-sulfidic ores by adding thereto a co-collector according to the present invention in an amount such that the recovery of valuable mineral in the flotation process is significantly increased.

DESCRIPTION OF THE INVENTION

Figure 1:
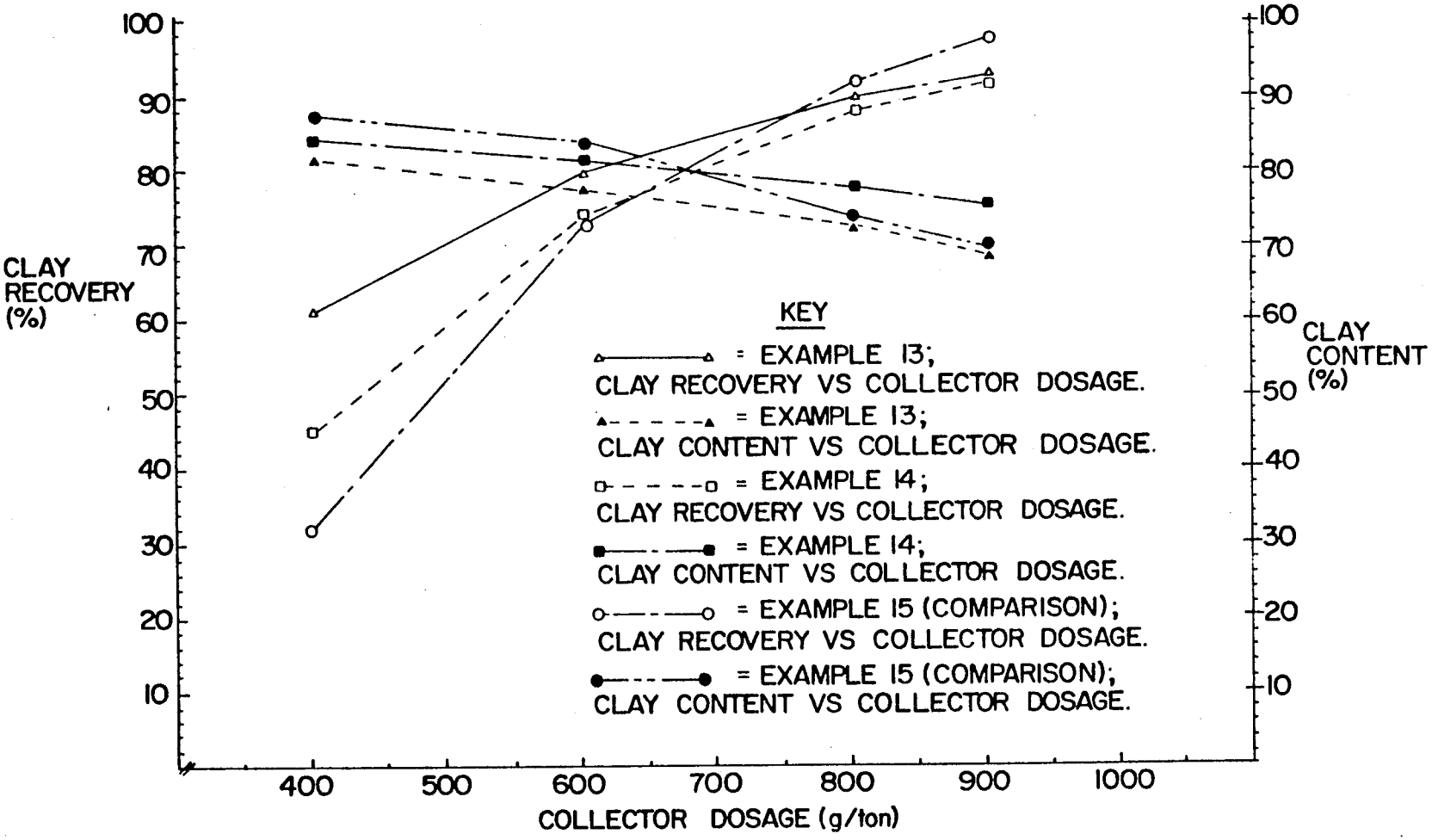
FIG. 1 is a graphic presentation of flotation results obtained in accordance with the present invention and in accordance with a control run; collector dosage for a kaolinite flotation is plotted against a) clay recovery (blank points) and b) clay content of recovered product (solid points)

It has now been found that alkyl glycosides, alkenyl glycosides and mixtures thereof can be used as co-collectors, to improve the collection efficiency of non-thio ionizable surfactant collectors for the froth flotation beneficiation of non-sulfidic ores.

Accordingly, the present invention relates to a method for the flotation of non-sulfidic ores using a collector selected from the group consisting of alkyl glycosides and alkenyl glycosides.

The present invention also relates to a method of improving the collection efficiency of non-thio ionizable surfactant collectors used for the froth flotation beneficiation of non sulfidic ores by adding a co-collector selected from the group consisting of alkyl glycosides and alkenyl glycosides thereto. The present invention relates to a non-sulfidic ore froth flotation beneficiation process which comprises slurrying the ore in water to form an aqueous pulp and sparging a gas through the pulp to selectively separate solid ore particles in a froth phase from other solid ore particles remaining in an aqueous phase in the presence of a collecting agent, wherein the collecting agent comprises a collector selected from the group consisting of an alkyl glycoside, an alkenyl glycoside and mixtures thereof.

A preferred froth flotation beneficiation process utilizes a collecting agent comprising:

(a) a collector selected from the group consisting of an alkyl glycoside, an alkenyl glycoside and mixtures thereof, and (b) a non-thio ionizable surfactant.

The alkyl or alkenyl residue of the glycosides used in accordance with the methods of the present invention may be linear or branched and may contain from about 2 to 18 carbon atoms. The alkyl or alkenyl residue may optionally contain a hydroxyl group and/or an ether linkage. Monoglycosides or polyglycosides containing from 2 to 8 glycoside residues are suitable for use in accordance with the present invention. Glycosides containing from 1 to 3 glycoside residues are preferred.

The alkyl and alkenyl glycosides used in accordance with the methods of the present invention are known compounds and may be synthesized by standard methods as disclosed in U.S. Pat. Nos. 3,547,828; 3,707,535 and 3,839,318; German Patent Applications Nos. 19 05 523; 19 43 689; 20 36 472; and 30 01 064 and in published European Patent Application No. 00 77 167. The disclosure of U.S. Pat. Nos. 3,547,828; 3,707,535 and 3,839,318 are incorporated herein by reference.

The alkyl and alkenyl glycosides are preferably produced by the reaction of glucose or an oligosaccharide with a corresponding alcohol containing from 2-18 carbon atoms. Suitable alcohols for producing the glycosides used in accordance with the invention include, for example, ethanol, n-propanol, i-propanol, n-butanol, i-butanol, sec.-butanol, ethylene glycol, 1,2-propylene glycol and 1,3-propylene glycol. Preferred glycosides are synthesized from fatty alcohols containing from 6 to 18 carbon atoms in a substantially unbranched carbon chain, such as n-hexanol, n-octanol, n-decanol, n-dodecanol, n-tetradecanol, n-hexadecanol and n-octadecanol. Also preferred are glycosides synthesized from unsaturated fatty alcohols which may contain up to three double bonds in the molecule, for example, n-octadecenol (oleyl alcohol). These alcohols may be either substantially pure or in the form of an alcohol mixture. Alcohol mixtures are used in particular for the production of alkyl and alkenyl glycosides from fatty alcohols of the type obtained by catalytic hydrogenation of methyl esters of naturally occurring fatty acids. Alkyl glycosides in which the alkyl group contains an ether linkage may be obtained, for example, by reacting a hydroxyalkyl glycoside under known conditions with an alkylene oxide containing 2-18 carbon atoms such as, ethylene oxide, propylene oxide or a dodecane epoxide containing terminal or internal epoxide groups. Glycosides such as these may of course also be obtained by reaction of glucose and oligosaccharides with glycol ethers, such as ethylene glycol monododecyl ether or propylene glycol monodecyl ether.

The saccharide residue of alkyl and alkenyl monoglycosides may be a cyclic sugar residue bonded to an alcohol, or an oligomer containing from about 2 to 8 glucose or maltose residues bonded together by glycosidic bonds. Alkyl and alkenyl glycosides containing from 1 to 3 glycoside residues are preferred. The above-mentioned ranges for the number of sugar residues represent a statistical average on which the distribution normally occurring with these products is based. Alkyl and/or alkenyl glycosides based on $C_{12}$–$C_{14}$ fatty alcohols and having 1 to 2 glycoside residues are particularly preferred.

The alkyl glycoside and alkenyl glycoside collectors are used with non-thio ionizable surfactants, such as anionic, cationic and ampholytic non-thio ionizable surfactants of the type conventionally used in the froth flotation of non-sulfidic ores.

Anionic non-thio ionizable surfactants useful in the froth flotation beneficiation of non-sulfidic ores according to the present invention include fatty acids, alkyl sulfates, alkyl sulfosuccinates, alkyl sulfosuccinamates, alkyl benzene sulfonates, alkyl sulfonates, petroleum sulfonates, acyl lactylates, organic phosphonates, alkyl phosphates, alkyl ether phosphates and hydroxamates.

Suitable fatty acids include straight-chain fatty acids containing from about 12 to 18 carbon atoms and preferably from about 16 to 18 carbon atoms obtained by lipolysis of fats and oils of vegetable or animal origin, and optionally, fractionation and/or separation by the hydrophilization process. Oleic acid and tall oil fatty acids are particularly preferred.

Suitable alkyl sulfates include sulfuric acid semiesters of fatty alcohols containing about 8 to 22 carbon atoms preferably about 12 to 18 carbon atoms. The fatty alcohol component of the sulfuric acid semiesters may be a straight-chain or branched, saturated or unsaturated and may contain from about 8 to 22 carbon atoms. Examples of fatty alcohols suitable for the fatty alcohol component of the sulfuric acid semiesters include n-octanol, n-decanol, n-dodecanol, n-tetradecanol, n-hexadecanol, n-octadecanol, n-eicosanol, n-docosanol, n-hexadecanol, isotridecanol, isooctadecanol and n-octadecenol. The sulfuric acid semiester may be derived from a single fatty alcohol. In general, however, the sulfuric acid semiester is derived from a fatty alcohol mixture which is in turn derived from the fatty acid component of fats and oils of animal or vegetable origin. Fatty alcohol mixtures may be obtained from the native fats and oils, inter alia by transesterification of triglycerides with methanol and subsequent catalytic hydrogenation of the fatty acid methyl ester. The fatty alcohol mixtures accumulating during catalytic hydrogenation as well as fatty alcohol fractions having limited chain-length range are both suitable in making the sulfuric acid semiesters. In addition to the fatty alcohol mixtures obtained from natural fats and oils, synthetic fatty alcohol mixtures, for example, the known Ziegler and oxo fatty alcohols are suitable starting materials for the production of the sulfuric acid semiesters.

Suitable alkyl sulfosuccinates include sulfosuccinic acid semiesters of fatty alcohols containing about 8 to 22, and preferably about 12 to 18 carbon atoms. These alkyl sulfosuccinates may be obtained, for example, by reacting corresponding fatty alcohols or fatty alcohol mixtures with maleic acid anhydride and subsequently adding an alkali metal sulfite or alkali metal hydrogen sulfite. The foregoing description of the fatty alcohol component of the sulfuric acid semiesters also applies to the fatty alcohol component of the sulfosuccinic acid semiesters.

Suitable alkyl sulfosuccinamates correspond to the following formula:

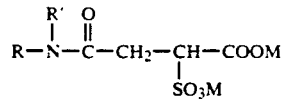

(I)

in which R is an alkyl or alkenyl group containing from about 8 to 22 carbon atoms and preferably from about 12 to 18 carbon atoms, R′ represents hydrogen or an alkyl group containing from about 1 to 3 carbon atoms and M is hydrogen, an alkali metal or ammonium, and preferably sodium or ammonium. The alkyl sulfosuccinamates corresponding to formula I are known compounds obtained, for example, by reacting corresponding primary or secondary amines with maleic acid anhydride and subsequent addition of alkali metal sulfite or alkali metal hydrogen sulfite. Examples of primary amines suitable for use in the preparation of the alkyl sulfosuccinamates include n-octyl amine, n-decyl amine, n-dodecyl amine, n-tetradecyl amine, n-hexadecyl amine, n-octadecyl amine, n-eicosyl amine, n-docosyl amine, n-hexadecenyl amine and n-octadecenyl amine. The alkyl sulfosuccinamates may be derived from a single amine, but more commonly are derived from amine mixtures. The alkyl component of the alkyl sulfosuccinamates derives from the fatty acid component of fats and oils of animal or vegetable origin. It is known to those skilled in the art that amine mixtures such as these may be synthesized from the fatty acids of native fats and oils obtained by lipolysis via the associated nitriles, by reduction with sodium and an alcohol or by catalytic hydrogenation. Secondary amines suitable for use in preparing the alkyl sulfosuccinamates corresponding to formula I include the N-methyl and N-ethyl derivatives of the primary amines mentioned above.

Suitable alkyl benzene sulfonates correspond to the following formula:

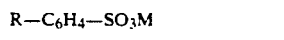

(II)

in which R is a straight-chain or branched alkyl group containing from about 4 to 16 and preferably from about 8 to 12 carbon atoms and M is an alkali metal or ammonium, and preferably sodium.

Suitable alkyl sulfonates correspond to the following formula:

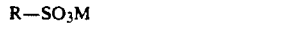

(III)

in which R is a straight-chain or branched alkyl group containing from about 8 to 22 carbon atoms and more preferably from about 12 to 18 carbon atoms and M is an alkali metal or ammonium, preferably sodium.

Suitable petroleum sulfonates may be obtained from lubricating oil fractions, generally by sulfonation with sulfur trioxide or oleum. Those compounds in which most of the hydrocarbon radicals contain from about 8 to 22 carbon atoms are particularly suitable.

Suitable acyl lactylates correspond to the following formula:

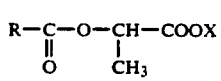

(IV)

in which R is an aliphatic, cycloaliphatic or alicylic radical containing from about 7 to 23 carbon atoms and X is a salt-forming cation. R is preferably an aliphatic, linear or branched, hydrocarbon radical which may be saturated, mono- or poly-unsaturated and which may optionally be substituted by hydroxyl groups. The use of the acyl lactylates corresponding to formula IV as collectors in the flotation of non-sulfidic ores is described in German Patent Application No. 32 38 060.

Suitable organic phosphonates include water-soluble salts of organic phosphonic acids, for example, salts of styrene phosphonic acid.

Suitable alkyl phosphastes and alkyl ether phosphates correspond to the following formulas:

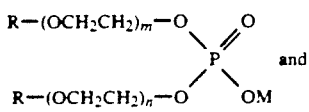

(V)

and

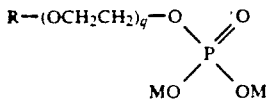

(VI)

in which R represents an alkyl or alkenyl residue having about 8 to 22 carbon atoms and M represents hydrogen, an alkali metal, or ammonium, preferably sodium or ammonium. The subscripts m, n and q in the case of the alkyl phosphates are equal to zero; in the case of the alkyl ether phosphates they represent numbers from about 2 to 15. The compounds of formulas V and VI represent known substances, which can be synthesized according to known methods. Suitable starting materials for the production of the alkyl phosphates include straight chain or branched alcohols having about 8 to 22 carbon atoms described above in connection with the alkyl sulfates and sulfuric acid half esters. Alkyl phosphates in which R has about 10 to 16 carbon atoms are particularly preferred. Starting materials for the production of the alkyl ether phosphates include addition products of about 2 to 15 moles ethylene oxide with the above mentioned alcohols containing about 8 to 22 carbon atoms. These addition products can be synthesized according to known methods. In the case of the alkyl ether phosphates, compounds of formulas V and VI, in which R contains about 18 to 22 carbon atoms, are preferred.

Suitable hydroxamates correspond to the following formula:

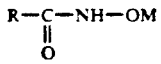

(VII)

in which R represents an alkyl residue having about 3 to 17 carbon atoms and M represents an alkali metal, preferably potassium. The class of compounds defined by formula VII is known. These compounds can be synthesized according to known methods, for example by reaction of hydroxlamine with fatty acid methyl esters. A suitable manufacturing process is described in Reagents in the Minerals Industry, The Institution of Mining and Metallurgy, London, 1984, pp. 161-168, which also describes the use of hydroxamates as collectors.

Cationic non-thio ionizable surfactants useful in the flotation of non-sulfidic ores according to the present invention include primary aliphatic amines, alkylene diamines substituted by α-branched alkyl groups, hydroxyalkyl-substituted alkylene diamines and water-soluble acid addition salts of these amines.

Suitable primary aliphatic amines include fatty amines containing about 8 to 22 carbon atoms derived from fatty acids of native fats and oils of the type mentioned above in connection with the alkyl sulfosuccinamates. In the case of primary aliphatic amines, mixtures of fatty amines are generally used, for example, tallow amines or hydrotallow amines of the type derived from tallow fatty acids or from hydrogenated tallow fatty acids via the corresponding nitriles and hydrogenation thereof.

Suitable alkyl-substituted alkylene diamines correspond to the following formula:

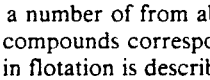

(VIII)

in which R and R' represent saturated or unsaturated, straight-chain or branched alkyl groups, which together contain from about 7 to 22 carbon atoms, and n is a number from about 2 to 4. The production of these compounds and their use in flotation is described in East German Patent Specification No. 64 275.

Suitable hydroxyalkyl-substituted alkylene diamines correspond to the following formula:

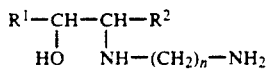

(IX)

in which $R^1$ and $R^2$ each represent hydrogen or an unbranched alkyl group containing from about 1 to 18 carbon atoms, the sum of the carbon atoms contained in $R^1$ and $R^2$ being within the range of about 9 to 18, and n is a number of from about 2 to 4. The production of the compounds corresponding to formula IX and their use in flotation is described in German Patent Application No. 25 47 987.

The amine compounds mentioned above may also be used in the form of their water-soluble salts. The salts are obtained by neutralization with a suitable quantity of acid. Suitable acids include, for example, sulfuric acid, phosphoric acid, hydrochloric acid, acetic acid and formic acid.

Ampholytic non-thio ionizable surfactants useful in the froth flotation beneficiation of non-sulfidic ores according to the present invention include compounds which contain at least one anion-active and one cation-active group in the molecule, the anion-active group(s) preferably being selected from sulfonic acid and carboxyl groups and the cation-active group(s) being selected from amino groups, preferably secondary or tertiary amino groups. Particularly suitable ampholytic surfactants are sarcosides, taurides, N-substituted aminopropionic acids and N-(1,2-dicarboxyethyl)-N-alkyl sulfosuccinamates.

Suitable sarcosides correspond to the following formula:

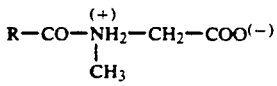

(X)

wherein R is an alkyl group containing about 7 to 21, preferably about 11 to 17, carbon atoms. These sarcosides are known compounds which may be obtained by known methods. For their use in froth flotation beneficiation processes, reference may be made to H. Schubert, Aufbereitung fester mineralischer Rohstoffe, 2nd Edition, Leipzig 1977, pp. 310–311, and the literature cited therein.

Suitable taurides correspond to the following formula:

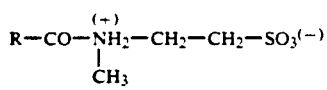

(XI)

wherein R is an alkyl group containing about 7 to 21, and preferably about 11 to 17, carbon atoms. These taurides are known compounds which may be obtained by known methods. For their use in froth flotation beneficiation processes, reference may be made to H. Schubert, mentioned above.

Suitable N-substituted aminopropionic acids correspond to the following formula:

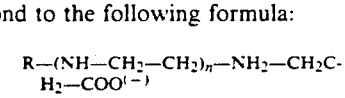

(XI)

wherein n is a number of from 0 to 4 and R is an alkyl or acyl group containing from about 8 to 22, and preferably from about 12 to 18, carbon atoms. These N-substituted aminopropionic acids are also known compounds which may be obtained by known methods. For their use as collectors in froth flotation beneficiation processes, see H. Schubert, mentioned above and Int. J. Min. Proc. 9 (1982), pp. 353–384.

Suitable N-(1,2-dicarboxyethyl)-N-alkyl sulfosuccinamates correspond to the following formula:

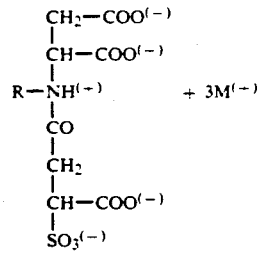

(XIII)

in which R is an alkyl group containing from about 8 to 22 carbon atoms and preferably from about 12 to 18 carbon atoms and $M^{(+)}$is a hydrogen ion, an alkali metal cation or an ammonium ion, and preferably a sodium ion. These N-(1,2-dicarboxyethyl)-N-alkyl sulfosuccinamates are known compounds which may be obtained by known methods. The use of these compounds as collectors in froth flotation beneficiation processes is also known, cf. H. Schubert mentioned above.

The ratio by weight of the alkyl and/or alkenyl glycoside to the non-thio ionizable surfactant component in the mixtures used in accordance with the present invention is in the range from about 1:19 to 3:1 and preferably in the range of from about 1:4 to 1:1.

The quantity of collecting agent used in accordance with the invention is greatly effected by the type of ore being beneficiated and by the valuable mineral content of the ore, and accordingly, may vary within wide limits. The collecting agents of the invention are generally used in quantities of from about 20 to 2000 g per metric ton of crude ore.

The activity of the collecting agents used in accordance with the invention is virtually unaffected by the hardness of the water used for preparing the froth flotation pulp.

In practice, the collecting agents of the present invention are used in place of known collectors in known flotation processes for the froth flotation beneficiation of non-sulfidic ores. Accordingly, other reagents commonly used, such as frothers, regulators, activators, deactivators, etc., may also be added to the aqueous suspensions of the comminuted ores. Flotation is carried out under conditions known to those skilled in the art. In this connection, reference is made to the following literature references on froth flotation beneficiation and ore preparation technology: Chemical Engineer's Handbook, 34d edition, McGraw Hill (1950) pps. 1085–91; H. Schubert, Aufbereitung fester mineralischer Rohstoffe, Leipzig 1967; B. Wills, Minerals Processing Technology Plant Design, New York, 1978; D. B. Purchas (ed.), Solid/Liquid Separation Equipment Scale-up, Croydon 1977; E. S. Perry, C. J. van Oss, E. Grushka (ed.), Separation and Purification Methods, New York 1973–1978.

The flotation methods in accordance with the present invention may be used, for example, in the flotation of apatite, scheelite and wolframite ores, in the separation of fluorite from quartz, in the separation of quartz or alkali silicates from hematite, magnetite and chromite by reverse flotation, in the separation of cassiterite from quartz and other silicates, and in the separation of iron and titanium oxides from quartz for the purification of vitreous sands.

The following Examples demonstrate the superiority of the collecting agents used in accordance with the invention. The tests were carried out under laboratory conditions, in some cases with collector concentrations considerably higher than necessary in commercial practice. Accordingly, the applications of the present invention are not limited to the specific separations and test conditions described in the Examples. All percentages are percentages by weight, unless otherwise indicated. The quantities indicated for reagents are all based on the amount of active substance.

EXAMPLES 1 TO 6

The ore subjected to froth flotation beneficiation was a scheelite ore from Austria which had the following chemical composition, based on its principal constituents:

| | |
|---|---|
| $WO_3$ | 0.4% |
| CaO | 8.3% |
| $SiO_2$ | 58.2% |
| $Fe_2O_3$ | 7.8% |
| $Al_2O_3$ | 12.5% |
| MgO | 6.9% |

The flotation batch had the following particle size distribution:

| | |
|---|---|
| 30% | <25 μm |
| 45% | 25–100 μm |
| 24% | 100–200 μm |

In Examples 2-6, the flotation collecting agent comprised a glycoside component and a non-thio ionizable surfactant component. Example 1 (comparative example) utilized only the non-thio ionizable surfactant component. The surfactant component used in Examples 1-6 was a sodium ammonium salt (molar ratio $Na:NH_4 = 1:1$) of a monoalkyl sulfosuccinate. The surfactant had an alkyl component derived from a technical grade oleyl-cetyl alcohol mixture (2% $C_{12}$; 3-8% $C_{14}$; 26-36% $C_{16}$; 58-68% $C_{18}$ 0-2% $C_{20}$; acid number 0.2; hydroxyl number 210-225; saponification number 2; iodine number 48-55). This is referred to as surfactant "A" in Table.

The glycosides used as the glycoside component in Examples 2-6 included the following:

1. hexadecyl monoglucoside, which is referred to as glycoside "B" in Table I; and
2. a monoglucoside based on technical grade lauryl alcohol (0-3% $C_{10}$; 48-58% $C_{12}$; 19-24% $C_{14}$; 9-12% $C_{16}$; 10-13% $C_{18}$; acid number 0; hydroxyl number 265-275; saponification number 1.2; iodine number 0.5) which is referred to as glycoside "C" in Table I.

The flotation tests were carried out at 23° C. in a modified Hallimond tube (microflotation cell) following the procedures established by B. Dobias, in Colloid and Polymer Sci. 259 (1981), pp. 775-776. Each test was carried out with 2 g of ore. Distilled water was used for preparing the pulp. The collector mixture was added to the pulp in an amount sufficient to give a total collector content of 500 g of collector per ton of ore. The conditioning time was 15 minutes in each test. During flotation, an air stream was sparged through the pulp at a rate of 4 ml/min. The flotation time was 2 minutes in each test.

The results obtained are set out in Table I. The particular collector components used are shown in the second and third columns and their ratio by weight in the fourth column. The fifth column shows the total recovery, as a percentage of the total quantity of ore, while the sixth column shows the recovery of metal, as a percentage of the total quantity of $WO_3$ in the ore. The $WO_3$, CaO and $SiO_2$ contents of the flotation concentrates are shown in the seventh, eighth and ninth columns, respectively.

Partial replacement of the monoalkyl sulfosuccinate component with the glucoside component distinctly improves the recovery of scheelite at the same collector concentration and, in some cases, provides slightly improved selectivity with respect to the scheelite.

TABLE I

| Flotation of Scheelite | | | | | | | | |
|---|---|---|---|---|---|---|---|---|
| Example No. | Non-thio Surfactant Component | Glycoside Component | Non-thio Surfactant: glycoside Weight Ratio | Total Recovery (%) | Metal Recovery (%) | Concentrate Content (%) | | |
| | | | | | | $WO_2$ | CaO | $SiO_2$ |
| 1* | A | — | — | 2.9 | 24 | 3.3 | 11.5 | 46.1 |
| 2 | A | B | 2:1 | 6.0 | 45 | 3.0 | 14.0 | 43.0 |
| 3 | A | B | 1:1 | 6.0 | 54 | 3.6 | 14.1 | 43.6 |
| 4 | A | B | 1:2 | 5.0 | 52 | 4.2 | 13.9 | 43.4 |
| 5 | A | C | 1:1 | 4.6 | 34 | 2.9 | 11.7 | 46.9 |
| 6 | A | C | 1:2 | 5.8 | 42 | 2.9 | 13.7 | 43.9 |

*Comparative Example

EXAMPLES 7 TO 10

The ore subjected to froth flotation beneficiation was a scheelite ore from Austria having the following chemical composition, based on its principal constituents:

| | |
|---|---|
| $WO_3$ | 0.4% |
| CaO | 6.8% |
| $SiO_2$ | 59.5% |
| $Fe_2O_3$ | 7.0% |
| $Al_2O_3$ | 12.1% |
| MgO | 5.7% |

The flotation batch had the following particle size distribution:

| | |
|---|---|
| 25% | <25 μm |
| 43% | 25-100 μm |
| 29% | 100-200 μm |

In Examples 8-10, the flotation collecting agent comprised a glycoside component and a non-thio ionizable surfactant component. Example 7 (comparative example) utilized only the non-thio ionizable surfactant component. The non-thio ionizable surfactant used as the surfactant component in Examples 7-10 was a technical grade oleic acid (saturated: 1% $C_{12}$; 3% $C_{14}$; 0.5% $C_{15}$; 5% $C_{16}$; 1% $C_{17}$; 26% $C_{18}$; monounsaturated: 6% $C_{16}$; 70% $C_{18}$; di-unsaturated: 10% $C_{18}$; tri-unsaturated: 0.5% $C_{18}$; acid number 199-204; saponification number 200-205; iodine number 86-96) and is referred to as surfactant "D" in Table II.

The glycosides used as the glycoside component in Examples 8-10 were the same as glycosides B and C used in Examples 2-6. The flotation tests were carried out in a modified Hallimond tube (microflotation cell) following the procedures of Examples 1 to 6.

The results obtained are set out in Table II. The partial replacement of the oleic acid component with the glucoside component distinctly improves the recovery and selectivity with respect to the scheelite at the same collector concentration.

TABLE II

| Flotation of Scheelite | | | | | | | | |
|---|---|---|---|---|---|---|---|---|
| Example No. | Non-thio Surfactant Component | Glycoside Component | Non-thio Surfactant: glycoside Weight Ratio | Total Recovery (%) | Metal Recovery (%) | Concentrate Content (%) | | |
| | | | | | | $WO_2$ | CaO | $SiO_2$ |
| 7* | D | — | — | 6.6 | 41 | 2.5 | 12.9 | 45.9 |
| 8 | D | B | 1:1 | 4.3 | 53 | 4.9 | 16.9 | 39.7 |

TABLE II-continued

| Flotation of Scheelite | | | | | | | | |
|---|---|---|---|---|---|---|---|---|
| Example No. | Non-thio Surfactant Component | Glycoside Component | Non-thio Surfactant: glycoside Weight Ratio | Total Recovery (%) | Metal Recovery (%) | Concentrate Content (%) | | |
| | | | | | | $WO_3$ | CaO | $SiO_2$ |
| 9 | D | C | 3:1 | 9.1 | 50 | 2.2 | 11.5 | 47.3 |
| 10 | D | C | 1:1 | 5.7 | 50 | 3.5 | 14.7 | 42.2 |

*Comparative Example

EXAMPLES 11 AND 12

The ore subjected to froth flotation beneficiation was a South African apatite which contained the following minerals as its principal constituents:

| | |
|---|---|
| 39% | magnetite |
| 11% | carbonates |
| 9% | olivine |
| 14% | phlogopite |
| 18% | apatite |

The $P_2O_5$ content of the ore was 6.4%. The flotation batch had the following particle size distribution:

| | |
|---|---|
| 18% | <25 μm |
| 34% | 25-100 μm |
| 43% | 100-200 μm |
| 5% | >200 μm |

The flotation tests were carried out at room temperature in a 1 liter laboratory flotation cell. Flotation was carried out with a pulp density of 500 g ore/l. The pulp was formed by mixing the ore with tapwater having a hardness of 16° dH (dH = German hardness). Magnetite was magnetically removed before flotation of the apatite. Flotation was carried out in a single stage over a period of 4 minutes at a mixer rotational speed of 1200 r.p.m., a pH of 10 and using waterglass in a quantity of 1000 g/ton of ore as depressor.

The type and quantity of the collector used are shown in the second column of Table III. The quantity of waterglass used as the depressor is shown in the third column, the $P_2O_5$ recovery in the fourth column and the $P_2O_5$ content of the recovery fraction in the fifth column.

In Example 11, the collecting agent comprised a non-thio surfactant component and a glycoside component. The surfactant component comprised 2.0 parts by weight (pbw) of the technical grade oleic acid surfactant D used in Examples 7 to 10. The glycoside component comprised 1.0 pbw of a monoglucoside based on a commercial grade lauryl alcohol (0-2% $C_{10}$; 70-75% $C_{12}$; 25-30% $C_{14}$; 0-2% $C_{16}$; acid number 0; hydroxyl number 285-295; saponification number 0.5; iodine number 0.3) which is referred to in Table III as glycoside "E".

In Example 12 (comparative example) only the non-thio ionizable surfactant D (same as the surfactant used in Examples 7-10) was used.

TABLE III

| Example No. | Non-thio Surfactant Component | Glycoside Component | Non-thio Surfactant:Glycoside Weight Ratio | Amount of both Collector Components (g/ton) | Depressor (g/ton) | $P_2O_5$ Recovery (%) | $P_2O_5$ Content (%) |
|---|---|---|---|---|---|---|---|
| 11 | D | E | 2:1 | 225 | 500 | 53 | 13.7 |
| 12* | D | — | — | 900 | 1000 | 57 | 15.3 |

*Comparative Example

As can be seen from Table III, the combination of the oleic acid surfactant with the glucoside in accordance with the present invention enables the collector and depressor dosages to be significantly reduced without significantly diminishing the recovery of phosphate, in comparison to the use of the surfactant alone.

The ore subjected to froth flotation beneficiation in Examples 13-16 was a kaolinite ore containing 55% clay and feldspar as gangue and having the following particle size distribution:

| | |
|---|---|
| 64% | <25 μm |
| 22% | 25-40 μm |
| 14% | >40 μm |

The flotation tests of Examples 13-16 were carried out at room temperature in a 1 liter laboratory flotation cell. Flotation was carried out at a pulp density of 250 g/l. The pulp was formed by adding the ore to tapwater having a hardness of 16° dH. Aluminum sulfate was used as a flotation activator in a quantity of 500 g/ton of ore. The pH of the pulp was adjusted to 3 with sulfuric acid. The conditioning time was 10 minutes. Flotation was carried out for 15 minutes at a rotational speed of 1200 r.p.m. The collector was added to the pulp in four portions.

EXAMPLE 13

The collecting agent used in Example 13 comprised a non-thio ionizable surfactant component and a glycoside component. The surfactant component comprised 2.0 pbw of a N-β-hydroxy-$C_{12}$-$C_{14}$-alkyl ethylene diamine formate prepared by reaction of a linear $C_{12}$-$C_{14}$ epoxyalkane with ethylene diamine and subsequent neutralization with formic acid (referred to herein as surfactant "F"). The glycoside component comprised 1.0 pbw of a monoglucoside based on a commercial grade lauryl alcohol (same as glycoside E used in Example 11).

EXAMPLE 14

The collecting agent used in Example 14 comprised a non-thio ionizable surfactant component and a glycoside component. The surfactant component comprised 2.0 pbw of a N-β-hydroxy-$C_{12}$-$C_{14}$-alkyl ethylene diamine formate (same as surfactant F used in Example 13). The glycoside component comprised 1.0 pbw of a propylene glycol glucoside in propylene glycol (referred to herein as glycoside "G").

EXAMPLE 15

COMPARISON EXAMPLE

The collector used in Example 15 was a non-thio ionizable surfactant comprising N-$\beta$-hydroxy-$C_{12}$-$C_{14}$-alkyl ethylene diamine formate (same as surfactant F used in Examples 13 and 14), with no glycoside component.

EXAMPLE 16

The collecting agent of Example 16 comprised a non-thio ionizable surfactant component and a glycoside component. The surfactant component comprised 2.0 pbw of a N-$\beta$-hydroxy-$C_{12}$-$C_{14}$-alkyl ethylene diamine formate (same as surfactant F used in Examples 13-15). The glycoside component comprised 1.0 pbw of a propylene glycol glucoside reacted with $\alpha$-dodecane epoxide (referred to herein as glycoside "H").

As can be seen from FIG. 1, partial replacement of the conventional amine surfactant F by the glucosides having $C_{12}$-$C_{16}$ alkyl chains accelerates flotation, particularly in the first stage without significant loss of selectivity.

Figure 2:
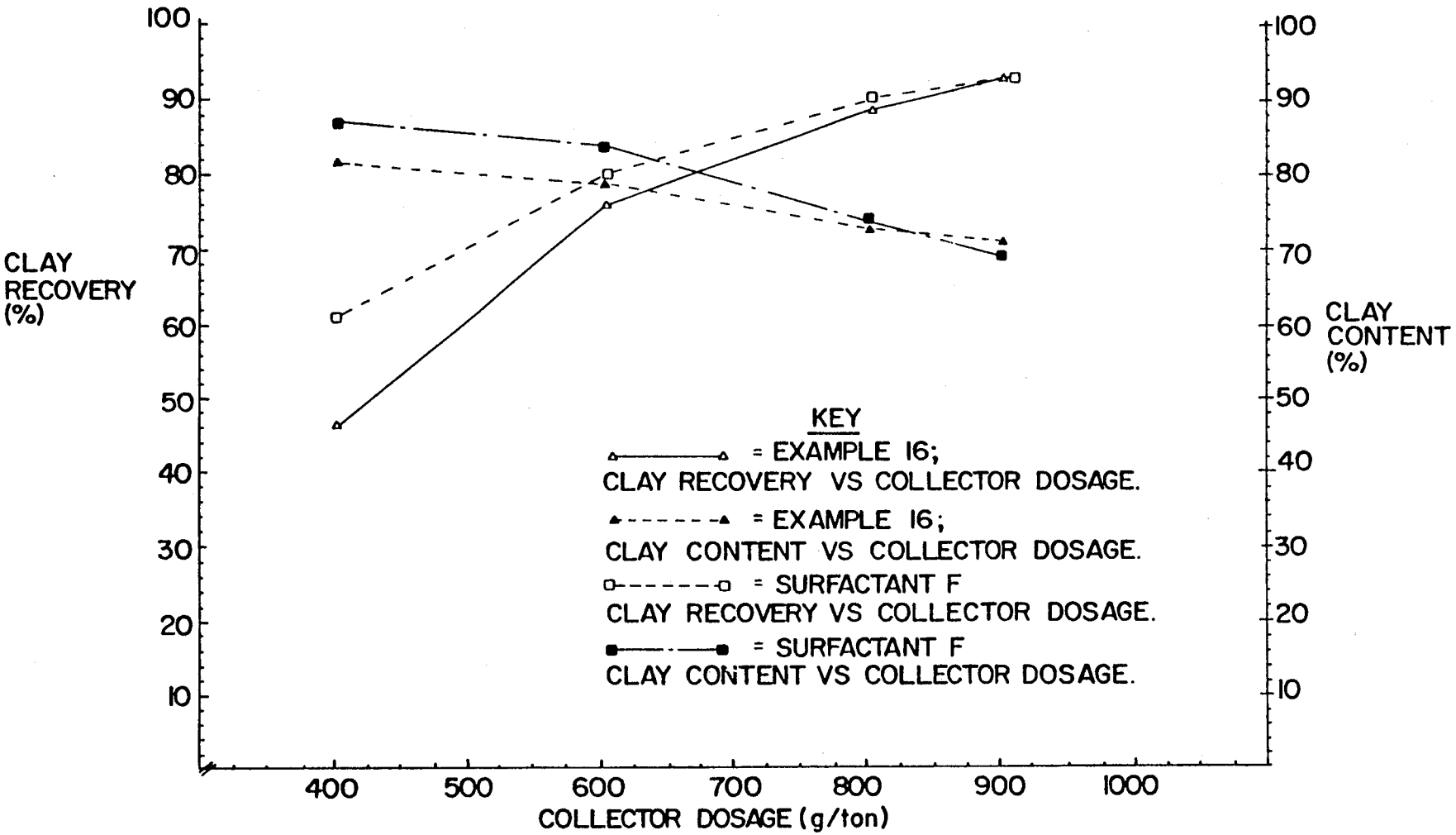
FIG. 2 is a similar graphic presentation.

FIG. 2 shows that glucoside H, when used in combination with conventional amine collectors, improve both the recovery of clay and also the degree of enrichment, particularly in the first stage of the flotation process.

EXAMPLES 17 TO 25

The ore subjected to froth flotation beneficiation was a low-grade cassiterite ore containing granite, tourmaline and magnetite as the gangue constituents. The $SiO_2$ content of the ore was approximately 1.0%. The ore had the following particle size distribution:

| | |
|---|---|
| 49.5% | <25 μm |
| 43.8% | 25-63 μm |
| 6.7% | >63 μm |

The flotation tests were carried out at room temperature in a 1 liter laboratory flotation cell. Waterglass was used as a depressor in a quantity of 2000 g/ton of ore. The pH of the pulp was adjusted to 5 with sulfuric acid before adding the collector. Flotation was carried out at a pulp density of 500 g of ore per liter of tapwater. The tapwater had a hardness of 16° dH. The flotation time of the rougher flotation was 4 minutes at a stirring speed of 1200 r.p.m.

The following collector components were used. The amounts of each of the surfactant and glycoside collector components, and their weight ratio in the case of two component collecting agents, is set forth in Table IV:

Glycoside E

A Monoglucoside based on a commercial grade lauryl alcohol (same as glycoside E used in Examples 11 and 13).

Glycoside I

A Monoglucoside based on a $C_{12}$-$C_{16}$ fatty alcohol (0-3% $C_{10}$; 60-64% $C_{12}$; 21-25% $C_{14}$; 10-12% $C_{16}$; 3% $C_{18}$; acid number 0; hydroxy number 280-290; saponification number 0.5; iodine number 0.3).

Surfactant J

Tetrasodium-N-(1,2-dicarboxyethyl)-N-octadecyl sulfosuccinamide.

Glycoside H

A propylene glycol glucoside reacted with $\alpha$-dodecane epoxide (same as glycoside H used in Example 16).

Surfactant K

Styrene phosphonic acid.

Surfactant L

A sodium/ammonium salt (molar ratio of Na:$NH_4$ is 1:1) of a monoalkyl sulfosuccinate having an alkyl group derived from a technical grade oleyl-cetyl alcohol (2% $C_{12}$; 3-8% $C_{14}$; 26-36% $C_{16}$; 58-68% $C_{18}$; 0-2% $C_{20}$; acid number 0.2; hydroxyl number 210-225; saponification number 2; iodine number 48-55).

The results obtained are set out in Table IV. Table IV shows that, in comparison with known cassiterite collectors such as styrene phosphonic acid (disclosed in Engineering and Mineral Journal 185, 1984, pp. 61-64) and tetrasodium-N-(1,2-dicarboxyethyl)-N-octadecyl sulfosuccinanamate (disclosed in Erzmetall 32, 1979, 9, pp. 379-383), the use of the alkyl and alkenyl glycosides with other non-thio ionizable surfactant collectors in accordance with the invention affords improvements with regard to the recovery of $SnO_2$ and/or the quantity of collector required.

TABLE IV

| Example No. | Non-thio Surfactant Component | Glycoside Component | Non-thio Surfactant: Glycoside Weight Ratio | Total Amount of Collector (g/ton) | $SnO_2$ Recovery (%) | $SnO_2$ Content (%) | Content of Accompanying Minerals | | |
|---|---|---|---|---|---|---|---|---|---|
| | | | | | | | $CO_2$ | $SiO_2$ | $Fe_2O_3$ |
| 17 | — | E | — | 300 | 96 | 3.3 | 15.3 | 30.9 | 14.2 |
| 18 | — | I | — | 300 | 89 | 3.5 | 14.2 | 34.0 | 14.1 |
| 19* | J | — | — | 300 | 69 | 4.3 | 14.8 | 38.6 | 15.4 |
| 20 | K | G | 1:1 | 300 | 98 | 9.8 | 11.6 | 28.2 | 18.5 |
| 21* | K | — | — | 450 | 82 | 5.8 | 10.5 | 40.2 | 13.5 |
| 22 | L | E | 1:2 | 120 | 83 | 4.5 | 18.5 | 29.1 | 13.1 |
| 23 | L | G | 1:2 | 150 | 98 | 3.4 | 18.1 | 29.4 | 14.1 |
| 24* | J | — | — | 300 | 69 | 4.3 | 14.8 | 38.1 | 15.4 |
| 25* | K | — | — | 450 | 82 | 5.8 | 10.5 | 40.2 | 13.5 |

*Comparative Example

We claim:

1. A non-sulfidic ore froth flotation beneficiation process which comprises slurrying the non-sulfidic ore in water to form an aqueous pulp and sparging a gas through the pulp to selectively separate solid ore particles in a froth phase from other solid ore particles remaining in an aqueous phase in the presence of a collecting agent, wherein the collecting agent comprises:

(a) a collector selected from the group consisting of an alkyl glycoside, an alkenyl glycoside, and mixtures thereof, and (b) a non-thio ionizable surfactant which is either (i) an anionic surfactant selected from the group consisting of alkyl sulfosuccinates, and organic phosphonates; or (ii) a cationic surfactant selected from the group consisting of primary aliphatic amines, alkylene diamines substituted by α-branched alkyl groups, hydroxyalkyl-substituted alkylene diamines, and water-soluble acid addition salts of the forgoing.

2. The process of claim 1, wherein the alkenyl glycoside contains from about 1 to 8 glycoside residues and has a linear or branched alkenyl group containing from about 2 to 18 carbon atoms.

3. The process of claim 1 wherein the glycoside and the surfactant are used in combined quantities of from about 20 to 2000 g per ton of ore.

4. The process of claim 1, wherein component (b) of the collecting agent is an alkyl sulfosuccinate.

5. The process of claim 1 wherein component (b) of the collecting agent is an organic phosphonate.

6. The process of claim 1, wherein the alkyl glycoside contains from about 1 to 8 glycoside residues and has a linear or branched alkyl group containing from about 2 to 18 carbon atoms.

7. The process of claim 6, wherein the glycoside contains an ether linkage.

8. The process of claim 6, wherein the glycoside contains from about 1 to 3 glycoside residues.

9. The process of claim 1 wherein the ratio by weight of glycoside to surfactant is in the range of from about 1:19 to 3:1.

10. The process of claim 9, wherein the ratio by weight is in the range of from about 1:4 to 1:1.

11. A non-sulfidic ore froth flotation beneficiation process which comprises slurring the non-sulfidic ore in water to form an aqueous pulp and sparging a gas through the pulp to selectively separate solid ore particles in a froth phase from other solid ore particles remaining in an aqueous phase in the presence of a collecting agent, wherein the collecting agent comprises:

(a) a collector selected from the group consisting of an alkyl glycoside, an alkenyl glycoside, and mixtures thereof, and (b) a cationic surfactant selected from the group consisting of primary aliphatic amines, alkylene diamines substituted by α-branched alkyl groups, hydroxyalkyl-substituted alkylene diamines, and water-soluble acid addition salts of the foregoing.

12. The process of claim 11 wherein the alkenyl glycoside contains from about 1 to 8 glycoside residues and has a linear or branched alkenyl group containing from about 2 to 18 carbon atoms.

13. The process of claim 11 wherein the glycoside and the surfactant are used in combined quantities of from about 20 to 2000 g per ton of ore.

14. The process of claim 11 wherein the alkyl glycoside contains from about 1 to 8 glycoside residues and has a linear or branched alkyl group containing from about 2 to 18 carbon atoms.

15. The process of claim 14 wherein the glycoside contains an ether linkage.

16. The process of claim 14 wherein the glycoside contains from about 1 to 3 glycoside residues.

17. The process of claim 11 wherein the ratio by weight of glycoside to surfactant is in the range of from about 1:19 to about 3:1.

18. The process of claim 17 wherein the ratio by weight is in the range of from about 1:4 to about 1:1.

* * * * *